United States Patent [19]

Lelental et al.

[11] Patent Number: 4,684,602

[45] Date of Patent: Aug. 4, 1987

[54] MULTICOLOR LASER RECORDING METHOD AND ELEMENT

[75] Inventors: Mark Lelental; James K. Lee; Alan P. VanKerkhove, all of Rochester, N.Y.

[73] Assignee: Eastman Kodak Company, Rochester, N.Y.

[21] Appl. No.: 880,432

[22] Filed: Jun. 30, 1986

[51] Int. Cl.[4] ..... G03C 7/00; G03C 7/32

[52] U.S. Cl. ..... 430/363; 430/391; 430/945

[58] Field of Search ..... 430/945, 363, 391

[56] References Cited

U.S. PATENT DOCUMENTS

| | | | |
|---|---|---|---|
| 3,956,658 | 5/1976 | Hornig | 313/217 |
| 4,054,916 | 10/1977 | Knop | 358/284 |
| 4,093,964 | 6/1978 | Aughton | 358/302 |
| 4,276,567 | 6/1981 | Wellendorf et al. | 358/280 |
| 4,319,268 | 3/1982 | Yamada | 358/75 |
| 4,343,873 | 8/1982 | Sasaoka | 430/945 X |
| 4,432,613 | 2/1984 | Ueda et al. | 350/358 |
| 4,515,462 | 5/1985 | Yoneda | 430/363 X |
| 4,569,903 | 2/1986 | Hashiue et al. | 430/945 X |

*Primary Examiner*—John E. Kittle
*Assistant Examiner*—Mukund J. Shah
*Attorney, Agent, or Firm*—John R. Everett

[57] ABSTRACT

A method of generating visible multicolor images using a single wavelength laser beam is disclosed.

13 Claims, 1 Drawing Figure

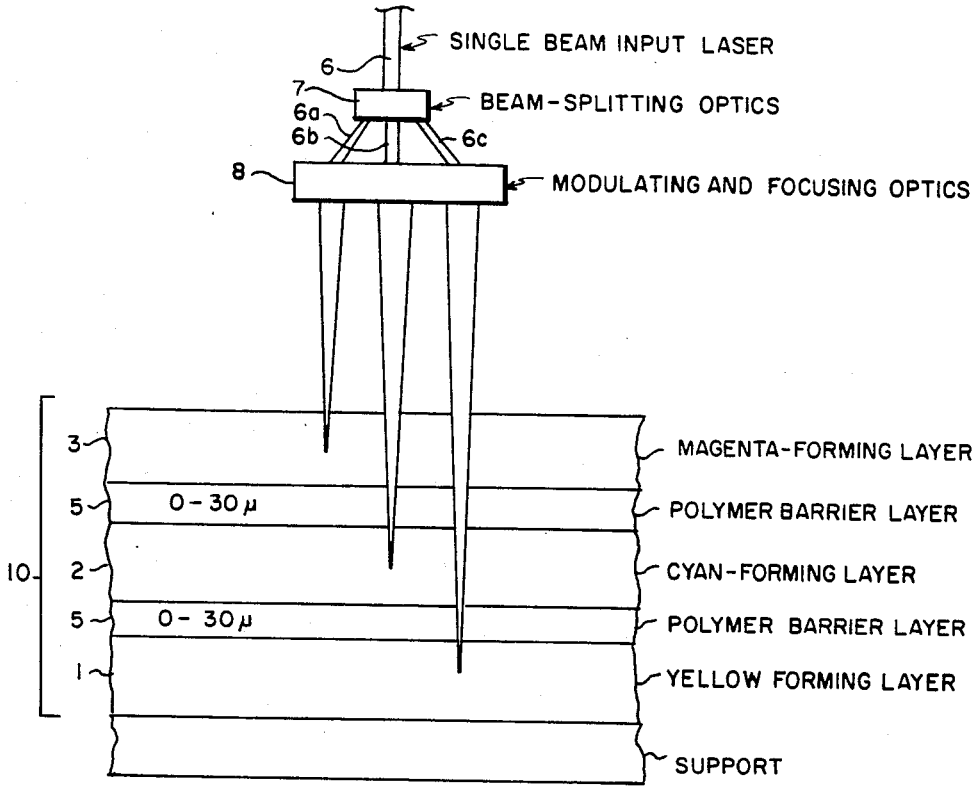
FIGURE

MULTICOLOR LASER RECORDING METHOD AND ELEMENT

FIELD OF THE INVENTION

This invention relates to a multicolor laser image recording method.

BACKGROUND OF THE INVENTION

Methods and apparatus for the electronic input and output of multicolor images using laser scanning techniques are known. Such methods and apparatus are disclosed, for example, in U.S. Pat. Nos. 3,956,658; 4,054,916; 4,093,964; 4,276,567; 4,319,268; and 4,432,613.

At the image input stage, an original multicolor image is raster scanned with a laser beam to obtain a plurality of photoelectronic signals representative of the original multicolor image. The signals are electronically separated into single color images, for example, red, green and blue images, or cyan, magenta and yellow, (referred to hereinafter as color separations). Each color separation is then electronically converted via computers to analogue or digital representations of each color separation.

The thus obtained analogue or digitized color separations signals may then be electronically manipulated to enhance or otherwise adjust each set of signals. After such electronic manipulations, each set of signals are stored until output of the original multicolor image is desired.

At the output stage, each color separation signal is passed to a computer which addresses an electro-optical modulator. The modulator modulates a laser beam adapted to raster scan a multilayer color photographic imaging element. In general, each layer of the element has been spectrally sensitized to different wavelengths of light. Each layer must therefore be exposed to different laser beam. The laser beam is modulated, according to the analogue or digitized color signal of each color separation. The thus modulated laser beam raster scans the color photographic element to produce a single color separated image on the photographic element.

A complete color rendition of the original multicolor image is obtained by reproducing each color separation separately. Each reproduced color separation is then registered with the other color separations to obtain a complete rendition of the multicolored original. In some apparatus more than one electro-optically modulated laser beam is used with an equal number of color photographic elements to produce all of the color separations at the same time.

The problem is that in either case the different color separations must still be registered to produce a complete rendition of the multicolored original image and a different wavelength laser beam is required for each layer of the photographic element.

Methods in which the need to register each color separation and the need for more than one wavelength laser beam is avoided are highly desirable.

SUMMARY OF THE INVENTION

The present invention provides a method of generating visible multicolor images comprising the steps of (A) providing an image printing device comprising a single wavelength laser beam modulated with image information for generating at least two different colors;

(B) providing a multilayer color photographic imaging element which contains at least two different color imaging layers; wherein each layer (i) forms a developable latent image;

(ii) has a short exposure latitude;

(iii) has a well defined sensitivity threshold;

(iv) has a pronounced low intensity reciprocity failure; and (v) is sensitive to the laser radiation.

(C) exposing each image layer to the laser by focusing the laser beam in and raster scanning each imaging layer separately to form a latent color image in each layer; and (D) developing a visible color image.

The foregoing method avoids the need for (1) registration of separately produced color separations of the original multicolor image and (2) laser beams of different wavelengths.

By making each layer of the multicolor imaging element sensitive to a single wavelength laser and focusing the laser beam in each layer of the element separately the need for (a) registering separately produced renditions of the color original and (b) multiple laser beams of different wavelengths is avoided.

BRIEF DESCRIPTION OF THE DRAWINGS

The FIGURE shows a schematic of the output end of an electronic imaging device and a generalized schematic of the multilayer color photographic imaging element utilized in the method of this invention.

DETAILS OF THE INVENTION

In the FIGURE there is shown a multilayer color photographic element generally designated 10. The element comprises a magenta image-forming layer 3, a cyan image-forming layer 2 and a yellow image-forming layer 1. Between the magenta image-forming layer 3 and the cyan image-forming layer 2 is a polymeric barrier layer 5. Between the cyan image-forming layer 2 and yellow image-forming layer 1 is a polymeric barrier layer 5.

Images are formed according to this embodiment of the invention in the photograhic element 10 as follows. Image output laser beam 6 is shown.

An output laser beam 6 is passed through an optical device 7 which splits the laser beam 6 into three laser sub-beams, *6a*, *6b* and *6c*. Each sub-beam is passed through a computer addressed electro-optical modulator that also includes focusing optics 8.

Methods and apparatus for computer addressing in electro-optic modulators with color image information are well known and are outside the scope of the present invention. In the embodiment of the invention shown in the FIGURE, the computer addressed modulator 8 receives all of the color information included in the original image at the same time. In another embodiment, the modulator can be set up to receive the image information in the form of single color separated images.

The computer and the electronics within the modulator are arranged in this embodiment so that sub-beam *6a* is modulated with the magenta color image information only; sub-beam *6b* is modulated with cyan color image information only and sub-beam *6c* is modulated with the yellow color image information. The focusing optics in the modulator is arranged so that sub-beam *6a* is focused on the magenta image-forming layer 3; sub-beam *6b* is focused in the cyan image-forming layer 2; and sub-beam 6c is focused on the yellow image-forming layer 1. Thus, when sub-beam 6a contains magenta image-forming information, the modulator 8 operates on sub-beam 6a. When sub-beam 6a contain a magenta image-forming information the beam is on and when sub-beam 6a contains no magenta image-forming information the beam is off. The same is true for beam 6b and the cyan image-forming layer 2 and for sub-beam 6c in the yellow image-forming layer 1.

The multilayer color photographic element 10 is designed and made so that each color imaging layer therein is sensitive to the same wavelength of laser radiation, has a short exposure latitude, a well-defined sensitivity threshold and pronounced low intensity reciprocity failure.

After each of the color image layers making up the complete multilayer photographic element are selected, the focusing optics are chosen so that each sub-beam 6a, 6b and 6c can be conveniently focused in the desired image-forming layer. The distance of the color photographic element from the focusing optics and the transparent barrier layers 5 included between the image-forming layers facilitate proper focusing of each sub-beam 6a, 6b and 6c, in the desired image-forming layer. The arrangement of the image-forming layers shown in the FIGURE is not essential. Any arrangement of the layer will be operative as long as the focusing optics and the barrier layers are adjusted to achieve the objective of focusing the sub-laser beams in the desired image-forming layer. The thickness of each barrier layer will therefore be dictated to some extent by the focal length of the focusing optics, and the wavelength of the selected laser beam. In some embodiments of the invention no barrier layer need be present. When the barrier layer is present, it must be transparent to the laser. In general, useful barrier layers will have a thickness of 0 to 30 microns.

In the method of this invention, one approach in building the multilayer color photographic element is to first choose the different color-imaging. layers. Then choose the optics for the system. The choice of the latter two elements define or dictate the thickness of the barrier layers, if any, to be included in the resulting photographic element.

Polymeric barrier layers are particularly useful in dye-forming photographic elements and processes to separate the dye-image forming layers. Such barrier layers enable control or prevention of transfer of components between layers. For example, a polymeric barrier layer can control the degree of transfer and development that can occur between layers in a multilayer dye-forming photothermographic element.

The polymeric barrier layer can also provide prevention or control of intermixing of components during coating of the dye-forming layers in preparation of a dye-forming element.

Any polymer is useful as a barrier layer provided that the polymer does not adversely affect the desired image-forming properties of the dye-forming element. Highly useful polymers as barrier layers are protective adhesives such as butadiene-styrene copolymers and ethylene-vinyl acetate copolymers and polymers that function as amine scavengens, that is the polymers comprise groups capable of reacting with amines, such as propanediamine, released by the dye-forming layers upon processing of the exposed dye-forming photothermographic element. Examples of useful polymers for barrier layer purposes are listed below:

poly{acrylamide-co-N-[4-(2-chloroethylsulfonymethyl)phenyl]acrylamide-co-sodium 2-acrylamido-2-methylpropaneslfonate} (weight ratio 75/20/5);

poly{acrylamide-co-N-[3-(2-chloroethylsulfonyl)propionylaminomethyl]acrylamide} (weight ratio 80/20);

poly{acrylamide-co-N-[3-(chloroacetamido)propyl]-methacrylamide-co-sodium 2-acrylamido-2-methylpropanesulfonate} (weight ratio 75/20/5);

poly{acrylamide-co-N-[3-(2-chloroethylsulfonyl)propionylaminomethyl]acrylamide-co-sodium 2-acrylamido-2-methylpropanesulfonate}(weight ratio 75/20/5);

poly{sodium 2-acrylamido-2-methylpropanesulfonate-co-N-[3-(2-chloroethylsulfonyl)propionylaminomethyl]acrylamide} (mole ratio 3/1; weight ratio 68/32);

poly{sodium 2-acrylamido-2- methylpropanesulfonate-co-N-[3-(chloroacetamido)propyl]methacrylamide} (mole ratio 3/1; weight ratio 73/27);

poly{sodium 2-acrylamido-2-methylpropanesulfonate-co-N-[4-(2-chloroethylsulfonylmethyl)phenyl]acrylamide} (mole ratio 3/1; weight ratio 67/33);

poly{acrylamide-co-N-[3-(chloroacetamido)propyl]-methacrylamide} (weight ratio 80/20);

poly{acrylamido-co-N-[4-(2-chloroethylsulfonylmethyl)phenyl]acrylamide} (weight ratio 95/5);

poly{acrylamide-co-N-[4-(2-chloroethylsulfonylmethyl)phenyl]acrylamide} weight ratio (80/20);

poly[acrylamide-co-m- & p-(2-chloroethylsulfonylmethyl)styrene-co-sodium 2-acrylamido-2-methylpropanesulfonate] (weight ratio 75/20/5);

poly{acrylamide-co-N-[3-(2-chloroethylsulfonyl)propionylaminomethyl]acrylamide} (weight ratio 80/20); and poly[acrylamide-co-acrylic acid] (weight ratio 70/30).

It is obviously clear that each image-forming layer must be selected so that the photosensitive material in the layer is sensitive to the radiation of the selected laser. The laser and an image-forming layer are properly matched when the photosensitive material in the layer absorbs light at the wavelength of the laser. When this match is properly made, the need for a different spectral sensitizer in each imaging layer is eliminated.

It is essential that each of the image-forming layers have a short exposure latitude. A short exposure latitude is necessary to obtain the necessary color discrimination in each layer. Short exposure latitude means that small increments of exposure produce large changes in optical density. Thus, short exposure latitude allows individual formation of a latent image in each imaging layer without formation of a latent image in any other layer. Each imaging layer may or may not have the same short exposure latitude. The short exposure latitude of each layer means that when the laser beam is focused in, for example, the cyan imaging layer, the exposure provided by the laser beam will be within exposure range of the cyan layer but below the exposure threshold of the magenta image-forming layer. This avoids color development in the magenta forming layer.

Each of the image-forming layers must also have a well-defined energy density threshold. The energy density threshold is the minimum laser exposure required to form a latent image in the layer in which the laser beam is focused. When the laser passes through the magenta imaging layer to the cyan or yellow imaging layer the energy density threshold is such that in the magenta and cyan imaging layers the laser beam does not provide the minimum energy density required to form a latent image in the magenta and cyan imaging layers. Thus, a sharply defined energy density threshold aids further in color discrimination between the different image-forming layers of the multilayer color photographic element 10.

Referring again to the FIGURE, it is seen that as sub-beam 6c is focused in the yellow imaging layer, sub-beam 6c passes through magenta and cyan imaging layers 2 and 3. Thus, both layers 2 and 3 are exposed to laser beam 6c anytime laser beam 6c is focused in layer 1.

To further avoid color forming reactions in layers 2 and 3 by the exposure thereof to sub-beam 6c, each imaging layer must also possess pronounced low intensity reciprocity failure. The intensity of the laser beam 6c passing through layers 2 and 3 is less intense per unit area in layers 2 and 3 than at the point of focus in the yellow forming layer 1. It is also clear that the time in which a particular spot in layers 2 and 3 are exposed to the laser beam will be as great or greater than the exposure time in layer 1. However, pronounced low intensity reciprocity designed into layers 2 and 3 will prevent such exposure from generating a latent image in layers 2 and 3. Low intensity reciprocity failure means, in the context of the present invention, that the threshold energy density necessary to form a latent image in a layer receiving low intensity exposure is orders of magniture greater than in a layer receiving higher intensity exposure.

Conventional as well as nonconventional multilayer color photographic elements may be used in the method of this invention. Such elements can be used without the need of different spectral sensitizing agents. Each layer used in the element is made to absorb light at the wavelength of the selected laser.

Conventional multilayer color photographic elements include elements based on the light sensitivity of silver halide. Such photographic elements are color photographic elements which form dye images through the (1) selective destruction of dyes or dye precursors such as silver dye bleach processes; (2) selective formation of dyes such as by reacting (coupling) a color-developing agent (e.g. a primary aromatic amine) in its oxidized form with a dye-forming coupler; and (3) the selective removal of dyes.

Such conventional photographic elements can be tailored by techniques well known to film builders in the photographic arts to have the essential short exposure latitude, well-defined energy density threshold and pronounced low intensity reciprocity failure required by the method of this invention.

Multilayer color silver halide photographic elements are well known, being disclosed in many text books, patents and other literature. Item 17643, Vol. 176, *Research Disclosure,* December 1978, published by Kenneth Mason Publications, Ltd., The Old Harbourmaster's, 8 North Street, Emsworth, Hampshire P010 7DD, England discloses the silver halide based multilayer color photographic elements useful in the present method. The *Research Disclosure* also provides a bibliography of the many patents in this field which would serve to teach those skilled in the art how to prepare useful silver halide based color multilayer photographic elements.

Conventional silver halide photographic elements can produce dye images through the selective formation of dyes, such as by reacting (coupling) a color-developing agent (e.g. a primary aromatic amine) in its oxidized form with a dye-forming coupler. The dye-forming couplers can be incorporated in the photographic elements as illustrated by Schneider et al, *Die Chemie,* Vol. 57, 1944, p. 113, Mannes et al U.S. Pat. No. 2,304,940, Martinez U.S. Pat. No. 2,269,158, Jelley et al U.S. Pat. No. 2,322,027, Frolich et al U.S. Pat. No. 2,376,679, Fierke et al U.S. Pat. No. 2,801,171, Smith U.S. Pat. No. 3,748,141, Tong U.S. Pat. No. 2,772,163, Thirtle et al U.S. Pat. No. 2,835,579, Sawdey et al U.S. Pat. No. 2,533,514, Peterson U.S. Pat. No. 2,353,754, Seidel U.S. Pat. No. 3,409,435 and Chen *Research Disclosure,* Vol. 159, July 1977, Item 15930.

In one form the dye-forming couplers are chosen to form subtractive primary (i.e. yellow, magenta and cyan) image dyes and are nondiffusible, colorless couplers, such as two and four equivalent couplers of the open chain ketomethylene, pyrazolone, pyrazolotriazole, pyrazologenzimidazole, phenol and naphthol type hydrophobically ballasted for incorporation in high-boiling organic (coupler) solvents. Such couplers are illustrated by Salminen et al U.S. Pat. Nos. 2,423,730, 2,772,162, 2,895,826, 2,710,803, 2,407,207, 3,737,316 and 2,367,531, Loria et al U.S. Pat. Nos. 2,772,161, 2,600,788, 3,006,759, 3,214,437 and 3,253,924, McCrossen et al U.S. Pat. No. 2,875,057, Bush et al U.S. Pat. No. 2,908,573, Gledhill et al U.S. Pat. No. 3,034,892, Weissberger et al U.S. Pat. Nos. 2,474,293, 2,407,210, 3,062,653, 3,265,506 and 3,384,657, Porter et al U.S. Pat. No. 2,343,703, Greenhalgh et al U.S. Pat. No. 3,127,269, Feniak et al U.S. Pat. Nos. 2,865,748, 2,93,391 and 2,865,751, Bailey et al U.S. Pat. No. 3,725,067, Beavers et al. U.S. Pat. No. 3,758,308, Lau U.S. Pat. No. 3,779,763, Fernandez U.S. Pat. No. 3,785,829, U.K. Pat. No. 969,921, U.K. Pat. No. 1,241,069, U.K. Pat. No. 1,011,940, Vanden Eynde et al U.S. Pat. No. 3,762,921, Beavers U.S. Pat. No. 2,983,608, Loria U.S. Pat. Nos. 3,311,476, 3,408,194, 3,458,315, 3,447,928, 3,476,563, Cressman et al U.S. Pat. No. 3,419,390, Young, U.S. Pat. No. 3,419,391, Lestina U.S. Pat. No. 3,519,429, U.K. Pat. No. 975,928, U.K. Pat. No. 1,111,554, Jaeken U.S. Pat. No. 3,222,176 and Canadian Pat. No. 726,651, Schulte et al U.K. Pat. No. 1,248,924 and Whitmore et al U.S. Pat. No. 3,227,550.

On laser exposure carried out as described above, optical signals corresponding to the cyan, magenta, yellow and neutral content of the color electronic signal acts on the light sensitive composition in the corresponding recording layer to form a latent image pattern.

This invisible pattern can subsequently be amplified to high-density cyan, magenta, yellow and neutral dye image by wet or dry chemical amplification processes.

Nonconventional multilayer color photothermographic elements, possessing characteristics (i), (ii), (iii), (iv) and (v), which are useful in the method of this invention include the following:

I. A multilayer color photothermographic element comprising a support bearing at least two different colored image-forming layers which are sensitive to radiation of the same wavelength; wherein each layer comprises a binder having dissolved or dispersed therein (a) a color developer;

(b) a color coupler;

(c) a photoreductant; and (d) a cobalt(III) Lewis base complex.

II. A multilayer color photothermographic element comprising a support bearing at least two different colored image-forming layers which are sensitive to radiation of the same wavelength; wherein each layer comprises a binder having dissolved or dispersed therein (a) a leuco dye;
(b) a reducing agent;
(c) a photoreductant; and
(d) a cobalt(III) Lewis base complex.

When element (I) is exposed, the photoreductant is activated by the laser to become a reducing agent. The thus formed reducing agent acts upon the cobalt(III) complex to form a cobalt(II) complex. The cobalt(II) complex is unstable and decomposes to release a Lewis base. The base then reacts with the color developer to form the active form of the color developer. The active form of the color developer reduces more cobalt(III) complex to form the oxidized form of the color developer. The oxidized form of the color developer then reacts with the color coupler to form the dye. The hue of the dye is determined by the selected color coupler. The latent image thus formed is developed by applying heat uniformly to the element. The color photothermographic element described in (I) are described in column 32 et sequel of U.S. Pat. No. 4,201,588.

In element I, any color coupler is useful provided it forms a dye upon oxidative coupling with the color developer upon laser exposure and thermal processing.

A color coupler is a compound or combination of compounds which, with the color developer oxidatively couples to produce a dye image upon heating after exposure.

Color couplers are known in the silver halide photographic art as color-forming couplers. Selection of an optimum color forming coupler or coupler combination will be influenced by such factors as the desired dye image, other components of the recording layer, processing conditions, particular color coupler in the recording layer and the like.

An example of a useful magenta forming coupler is 1-(2,4,6-trichlorophenyl)-3-{3-[α-(3-pentadecylphenoxy)butyramido]benzamido}-5-pyrazolone. A useful cyan forming coupler is 2,4-dichloro-1-naphthol. A useful yellow forming coupler is α-{3-[α-(2,4-di-tertiaryamylphenoxy)acetamido]benzoyl}-2-fluoroacetanilide.

Useful cyan, magenta and yellow dye-forming couplers are selected from those known in the photographic art such as described in, for example, "Neblette's Handbook of Photography and Reprography", edited by John M. Sturge, Seventh Edition, 1977, pages 120 and 121, and the above cited *Research Disclosure,* Vol. 176, December 1978, Item 17643, paragraphs VII C–G.

Other examples of useful dye-forming couplers are as follows:

Couplers which form cyan dyes upon reaction with the oxidized form of reducing agent, especially a color developing agent, are described in such representative patents and publications as U.S. Pat. Nos. 2,772,162; 2,895,826; 3,002,836; 3,034,892; 2,474,293; 2,423,730; 2,367,531; 3,041,236; and 4,248,962. Preferably such couplers are phenols and naphthols which form cyan dyes on reaction with oxidized color developing agent in the presence of a Lewis base in the dye-forming light exposed recording element upon processing. Structures of examples of such couplers are:

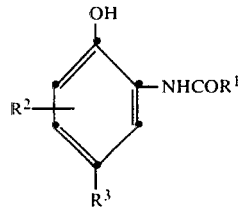

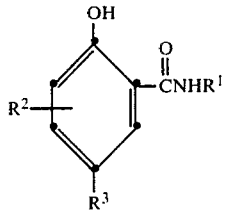

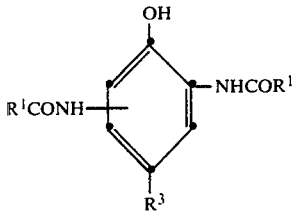

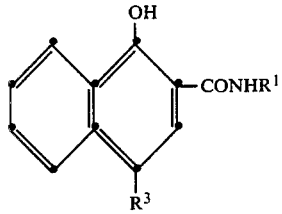

wherein $R^1$ represents alkyl of 1 to 20 carbon atoms or aryl of 6 to 20 carbon atoms;

$R^2$ represents one or more halogen, such as chlorine or fluorine; alkyl, such as alkyl containing 1 to 20 carbon atoms, for example, methyl, ethyl, propyl and butyl; or alkoxy, such as alkoxy containing 1 to 20 carbon atoms, for example, methoxy, ethoxy, propoxy and butoxy; and $R^3$ is hydrogen or a coupling-off group, that is a group capable of being released upon reaction of the oxidized form of the reducing agent with the coupler, with the proviso that at least one of $R^1$ and $R^2$ is a ballast group, i.e. an alkyl, alkoxy, or aryl group of 7 or more carbon atoms.

Couplers which form magenta dyes upon reaction with the oxidized form of a reducing agent, especially a color developing agent, are described in such representative patents as U.S. Pat. Nos. 2,600,788; 2,369,489; 2,343,703; 2,311,082; 3,152,896; 3,519,429; 3,062,653; 2,908,573; and 4,248,962. Preferably such couplers are pyrazolones, pyrazoloimidazoles and pyrazolotriazoles which form magenta dyes upon reaction with the oxidized form of the described reducing agent, especially a color developing agent. Structures of examples of such couplers are:

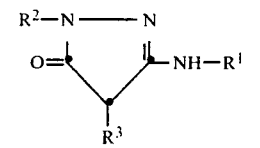

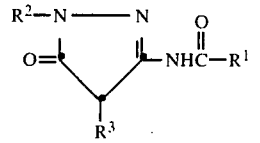

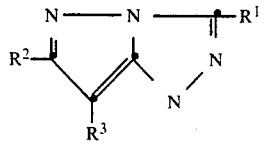

wherein $R^1$ and $R^3$ are as defined above; and $R^2$ is as defined above or is phenyl or substituted phenyl, such as 2,4,6-trichlorophenyl.

Couplers which form yellow dyes upon reaction with the oxidized form of a described reducing agent, especially a color developing agent, are described in such representative patents as U.S. Pat. Nos. 2,875,057; 4,407,210; 3,265,506; 2,298,443; 3,048,194; 3,447,928; and 4,248,962. Preferably such yellow dye-forming couplers are acylacetamides, such as benzoylacetanilides and pivalylacetanilides. Structures of examples of such yellow dye-forming couplers are:

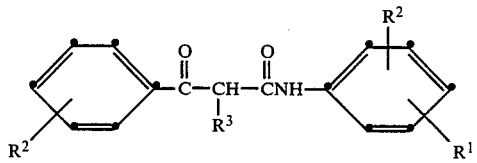

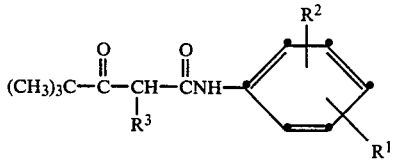

wherein $R^1$ and $R^3$ are as defined above;

$R^2$ is hydrogen; one or more halogen, such as chlorine or bromine; alkyl, such as alkyl containing 1 to 4 carbon atoms, for example, methyl, ethyl, propyl, or butyl; or a ballast group, such as an alkoxy group containing 16 to 20 carbon atoms or an alkyl group containing 12 to 30 carbon atoms.

Couplers which form black dyes upon reaction with the oxidized form of a reducing agent, especially a color developing agent, are described in such representative patents as U.S. Pat. Nos. 1,939,231; 2,181,944; 2,333,106; 4,126,461; 4,429,035; and 4,200,466. Preferably such black dye-forming couplers are resorcinolic couplers or m-aminophenol couplers. Structures of examples of such black dye-forming couplers are:

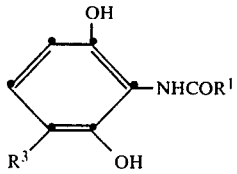

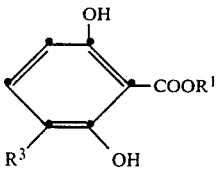

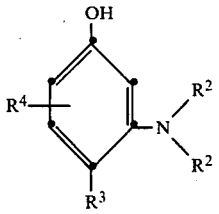

wherein $R^1$ is alkyl containing 3 to 20 carbon atoms, phenyl, or phenyl substituted with hydroxy, halo, amino, alkyl of 1 to 20 carbon atoms, or alkoxy of 1 to 20 carbon atoms;

each $R^2$ is independently hydrogen, halogen, alkyl, such as alkyl of 1 to 20 carbon atoms, alkenyl, such as alkenyl of 1 to 20 carbon atoms, or aryl, such as aryl of 6 to 20 carbon atoms;

$R^3$ is hydrogen or a coupling-off group;

$R^4$ is one or more halogen, alkyl, such as alkyl of 1 to 20 carbon atoms, alkoxy, such as alkoxy of 1 to 20 carbon atoms, or other monovalent organic groups that do not adversely affect coupling activity of the described couplers.

A typical black dye-forming coupler is 2-acetamidoresorcinol.

Examples of useful dye-forming couplers are:

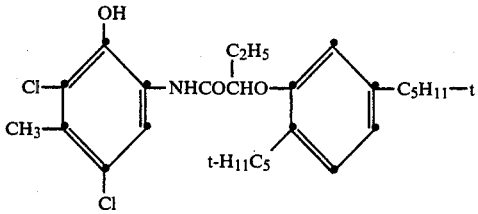

cyan

-continued
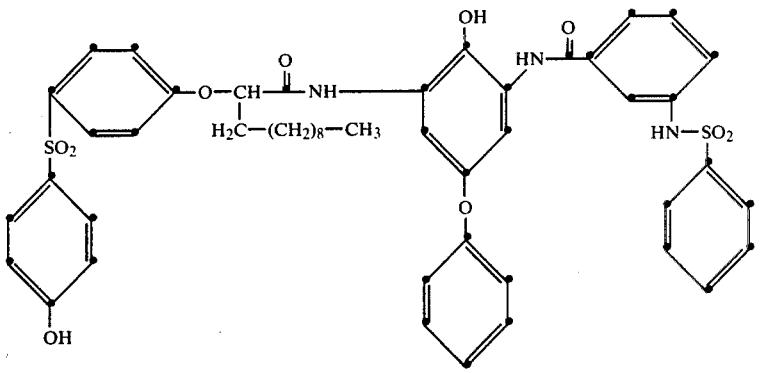
cyan
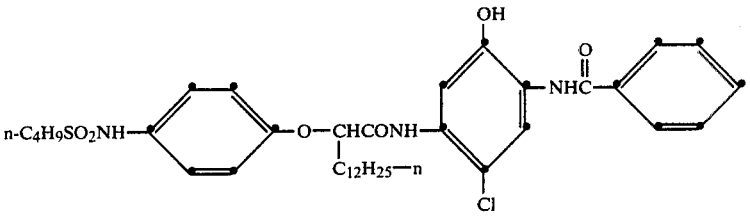
cyan
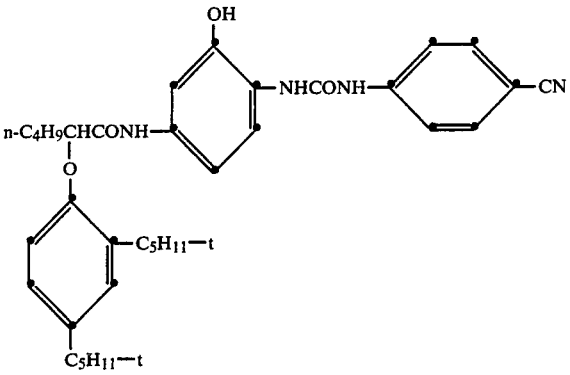
cyan
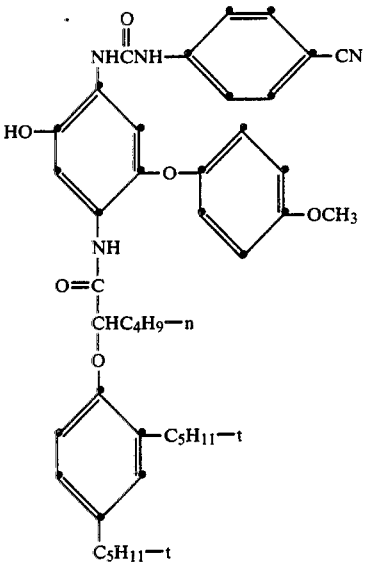
cyan
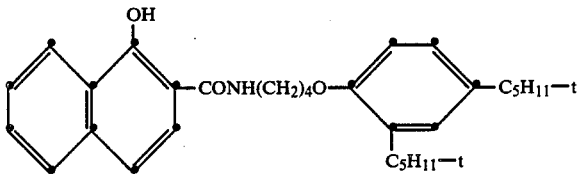
cyan
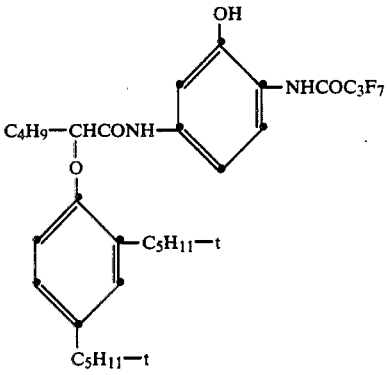

-continued
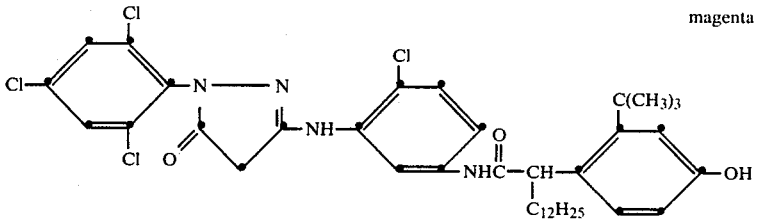
magenta
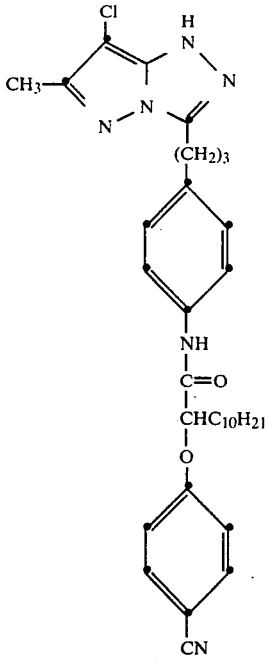
magenta
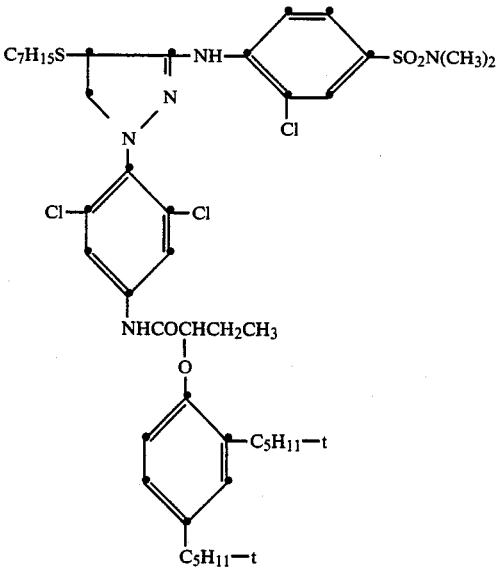
magenta
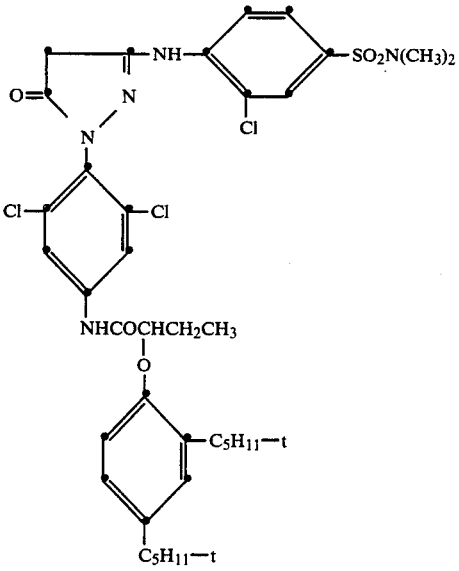
magenta -continued magenta

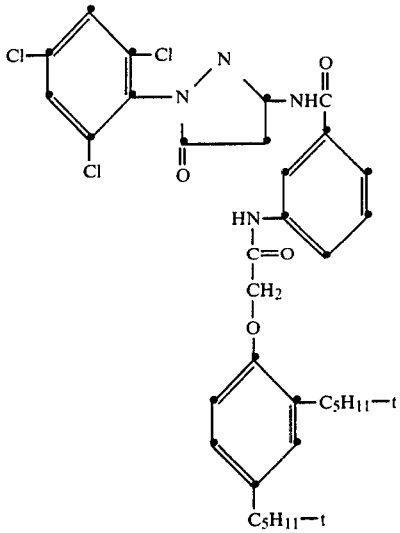

magenta

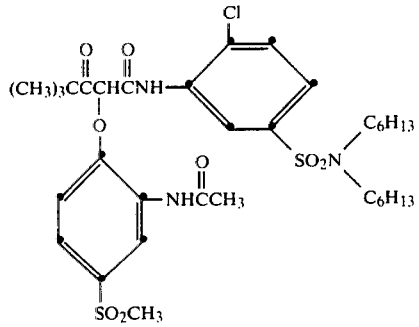

yellow

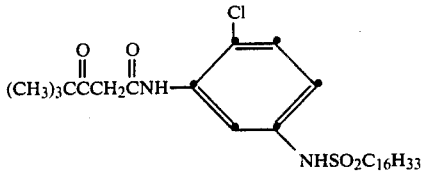

yellow

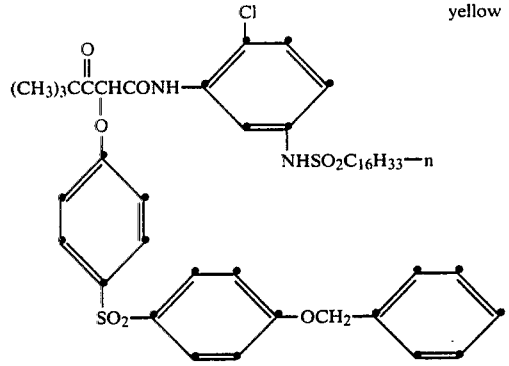

yellow

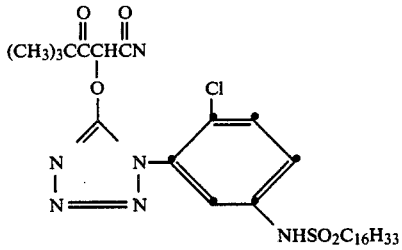

yellow

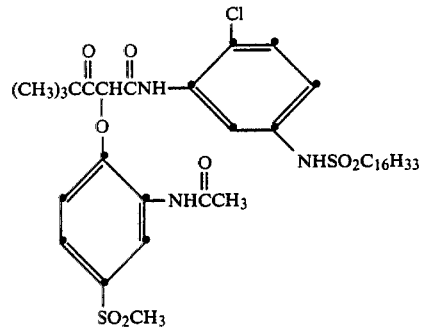

yellow

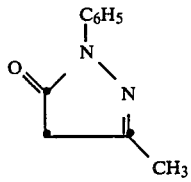

Useful color developers are aminophenols, phenyldiamines and hydrazones, preferably 4-amino-2,6-dibromo-3-methylphenol and 3-ethylbenzothiazol-2-one-benzenesulfonylhydrazone.

Element II is a photothermographic element in which, upon exposure, the photoreductant becomes an active reducing agent. The reducing agent reacts with the cobalt(III) complex to form the unstable cobalt(II) complex. The complex then decomposes to release a Lewis base. The released base reacts with the nonlight-sensitive reducing agent to activate the latter. The activated nonlight-sensitive reducing agent reduces the leuco dye to its color form. The thus formed latent image can be developed by the application of uniform heat. Element II is described in above mentioned U.S. Pat. No. 4,201,588.

A wide variety of leuco dyes are known to the art that can be readily employed in element II. Exemplary leuco dyes include aminotriarylmethanes, aminoxanthenes, aminothioxanthenes, amino-9,11-dihydroacridines, aminohydrocinnamic acids (cyanoethanes), aminodiphenylmethanes, aminohydrocinnamic acids (cyanoethanes), leucoindigoid dyes, tetrazolium salts, 1,4-diamino-2,3-dihydroanthraquinones, etc.

The photoreductant in elements I and II is in each sensitive layer of the elements. Its spectral response must be matched to the laser selected to carry out the exposure step of the method. The photoreductant may be the same or different in each light-sensitive layer. The laser emission and the photoreductant absorption are matched when the laser emission is absorbed by the photoreductant. Thus, a useful laser beam can be used anywhere within the absorption range of the photoreductant. The laser need not be selected specifically for maximum absorption.

The term "photoreductant" designates a material capable of molecular photolysis or photoinduced rearrangement to generate a reducing agent. This reducing agent spontaneously or with the application of heat reduces the cobalt(III) complex. The photoreductants employed in the practice of this invention are to be distinguished from spectral sensitizers. While spectral sensitizers may in fact form a redox couple for the reduction of cobalt(III) complexes (although this has not been confirmed), such sensitizers must be associated with the cobalt(III) complex concurrently with receipt of actinic radiation in order for cobalt(III) complex reduction to occur. By contrast, when a photoreductant is first exposed to actinic radiation and thereafter associated with a cobalt(III) complex, reduction of the cobalt(III) complex still occurs. A wide variety of useful photoreductants are known in the patent literature. Photoreductants which are useful with cobalt(III) Lewis base complexes are disclosed in U.S. Pat. No. 4,243,737, column 27 et sequel.

Useful cobalt(III) complexes for use in elements I and II are known in the imaging art and are described in, for example, *Research Disclosure,* Vol. 168, Item No. 16845; *Research Disclosure,* Vol. 126, Item No. 12617; *Research Disclosure,* Vol. 185, Item No. 18535; *Research Disclosure,* Vol. 158, Item No. 15874; *Research Disclosure,* Vol. 184, Item No. 18436; U.S. Pat. No. 4,273,860; U.K. published Application No. 2,012,445A; European Pat. No. 12,855; and published application WO 80/01322, the disclosures of which are incorporated herein by reference.

Cobalt(III) complexes feature a molecule having a cobalt ion surrounded by a group of other molecules which are generically referred to as ligands. The cobalt in the center of these complexes is a Lewis acid while the ligands are Lewis bases. Cobalt(III) complexes, are generally most useful because the ligands are relatively tenaciously held in these complexes and released when the cobalt is reduced to the (II) state.

Preferred cobalt(III) complexes are those having a coordination number of six. A wide variety of ligands are useful to form a cobalt(III) complex. The preferred cobalt(III) complex is one which aids in generating an amine. Cobalt(III) complexes which rely upon chelation of cobalt(II) to form added dye density are also useful in materials according to the invention. Useful amine ligands in cobalt(III) complexes according to the invention include, for example, methylamine, ethylamine, ammines, and amino acids such as glycinato. The term "ammine" refers to ammonia, when functioning as a ligand, whereas "amine" indicates the broader class noted above. Cobalt(III) hexammine complexes are highly useful in producing dye images.

Elements I and II also comprise a binder. The elements typically comprise a variety of colloids and polymers alone or in combination as vehicles and binding agents. These vehicles and binding agents are in various layers of the element, especially in the recording layers.

Useful materials are hydrophobic or hydrophilic. Accordingly, the selection of an optimum colloid or polymer, or combination of colloids or polymers, depends upon such factors as the particular polymer, particular components in the layer, desired image and particular processing conditions.

Useful colloids and polymers are transparent or translucent and include both naturally occurring substances, such as proteins, for example, gelatin, gelatin derivatives, cellulose derivatives, polysaccharides, such as dextran, gum arabic and the like and synthetic polymers. Useful polymeric materials for this purpose include polyvinyl compounds, such as poly(vinyl pyrrolidone), acrylamide polymers and dispersed vinyl compounds, such as in latex form. Effective polymers include water insoluble polymers of alkyl acrylates and methacrylates, acrylic acid, sulfoalkyl acrylates, methacrylates and those which have crosslinking sites which facilitate hardening or curing. Especially useful polymers are high molecular weight materials and resins which are compatible with the described components of the element according to the invention. These include, for example, poly(vinyl butyral), cellulose acetate butyrate, poly(methyl methacrylate), poly(vinyl pyrrolidone), ethyl cellulose, polystyrene, poly(vinyl chloride), poly(isobutylene), butadiene-styrene copolymers, vinyl chloride-vinyl acetate copolymers, copolymers of vinyl acetate, vinyl chloride and maleic acid and poly(vinyl alcohol).

Highly preferred binders include cellulose esters such as cellulose acetate butyrate and acrylic esters such as poly(methyl methacrylate).

An illustrative group of useful polymeric binders in a dye-forming element as described is represented by the formula:

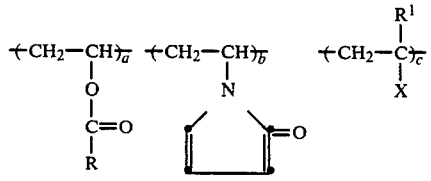

wherein

R is alkyl, such as alkyl containing 1 to 10 carbon atoms, for example, methyl, ethyl, propyl, butyl and decyl; aryl, such as aryl containing 6 to 10 carbon atoms, for example, phenyl and naphthyl; or aralkyl, such as aralkyl containing 7 to 15 carbon atoms, for example, benzyl and phenethyl;

$R^1$ is hydrogen or methyl;

a is 99 to 50 weight percent;

b is 50 to 1 weight percent;

c is 0 to 15 weight percent;

X is aryl, such as aryl containing 6 to 12 carbon atoms, for example, phenyl, naphthyl and biphenylyl; or $$-\overset{O}{\overset{\|}{C}}-Z-R^2 \text{ wherein Z is } -O- \text{ or } -\underset{R^3}{\underset{|}{N}}-;$$

$R^2$ and $R^3$ are individually hydrogen, alkyl, preferably alkyl containing 1 to 10 carbon atoms, such as methyl, ethyl, propyl, octyl and decyl; or aryl, preferably aryl containing 6 to 16 carbon atoms, such as phenyl and naphthyl; provided that $R^2$ is hydrogen when Z is $$-\underset{R^3}{\underset{|}{N}}-.$$

An especially useful polymeric binder within this group of binders is poly(vinyl acetate-co-vinyl benzoate-co-N-vinyl-2-pyrrolidone).

Optionally, an organic or inorganic acid is added to the image-forming layers to aid imaging. For example, p-toluenesulfonic acid and/or benzoic acid can help promote improved image discrimination.

The imaging layers of elements I and II are coated by coating procedures known in the photographic art, including dip coating, airknife coating, curtain coating or extrusion coating using hoppers known in the photographic art. If desired, two or more layers are coated simultaneously.

The various components of the photosensitive materials useful in the invention are prepared for coating by mixing the components with solutions or mixtures, including organic solvents, depending upon the particular photosensitive material and the components. The components are mixed and added by means of procedures known in the photographic art. Again, U.S. Pat. No. 4,210,588 is instructive in this regard for both elements I and II.

In one embodiment the cobalt(III) coordiation complex, color developer, color coupler, and an organic acid or inorganic acid are dissolved in a polymeric binder solution and coated as one of the image-forming layers.

Development of elements I and II, after latent image formation, is carried out by heating the elements using techniques and means known in the photographic art. For example, heating is carried out by passing the imagewise exposed element over a heated platen or drum or through heated rolls, by heating the element by means of microwaves, by means of dielectric heating or by means of heated air. A visible image is produced in the exposed element within a short time, typically within about 1 to about 90 seconds upon heating between 100°–200° C., preferably 110° C. to 180° C. The optimum temperature and time for processing depends upon such factors as the desired image, the particular element and heating means.

The method of this invention would generally be used in conjunction with an electronic printer having a printhead comprising the laser. For optimum printing, the printhead should scan close to the photographic element or the photographic element should rotate closely past the head. In a preferred embodiment of this invention the imaging element would rotate on a vacuum drum. This would allow a close tolerance to be maintained on the location of the laser beam with regard to the imaging element.

The practice of the invention is illustrated by the following examples.

EXAMPLE 1

Preparation of a Photothermographic Element

A. Cyan

The following composition was coated onto a poly(ethylene terephthalate) film support at 50μ wet thickness:

Ten ml of a 7.5% solution of poly(vinyl acetate-co-1-vinyl-2-pyrrolidone-co-vinyl benzoate) (weight ratio 50/30/20) binder in 7:3 methanol:acetone, 0.030 gm SF1066 surfactant (General Electric Company), 0.554 gm of tris(trimethylenediamine)-Co(III)-trifluoromethylsulfonate, 0.187 gm of 2,2,3,3,4,4,4-heptafluoro-2'-hydroxy-4'-[2-(m-pentadecylphenoxy)butyramido]-butyranilide coupler, 0.024 gm of p-toluenesulfonic acid, 0.052 gm of 4-amino-2,6-dibromo-3-methylphenol developer, 0.050 gm of 2-hydroxyethyl-1,4-naphthoquinone photoreductant and dried for 5 minutes at 45° C.

B. Barrier Layer

A Pliolite KR-03 barrier layer was prepared by coating a 15% solution of Pliolite KR-03 polymer (a butadiene-styrene copolymer sold by Goodyear Tire and Rubber Co.) in 1,1,1-trichloroethane onto the cyan dye-forming layer of Part A. at 200μ wet thickness. The solvent was removed by drying for 5 minutes at 45° C. to give a layer 20μ thick.

C. Magenta

The following composition was coated onto the Pliolite KR-03 barrier layer:

Ten ml of a 7.5% solution of the same binder used in Part A in 7:3 methanol:acetone, 0.030 gm SF1066 surfactant (General Electric Company), 0.613 gm of tris(-trimethylenediamine)-Co(III)-trifluoromethylsulfonate, 0.168 gm of 3-[2-chloro-4-(N,N-dimethylsulfamoyl-)anilino]-1-{4-[2-(2,5-di-t-amylphenoxy)butyramido]-2,6-dichlorophenyl}-4-heptylthio-2-pyrazolin-5-one coupler, 0.030 gm of p-toluenesulfonic acid, 0.052 gm of 4-amino-2,6-dibromo-3-methylphenol developer, 0.050 gm of 2-hydroxyethyl-1,4-naphthoquinone photoreductant and dried for 5 minutes at 45° C.

D. Yellow

The following composition was coated onto the back side of the film support:

Ten ml of a 5% solution of cellulose acetate butyrate binder in 9:1 acetone:methanol, 0.060 gm of SF1066 surfactant (General Electric Company), 0.204 gm of tris(trimethylenediamine)-Co(III)-trifluoromethylsulfonate, 0.010 gm of p-toluenesulfonic acid, 0.018 gm of 3-methyl-1-phenyl-2-pyrazolin-5-one coupler, 0.024 gm of 3-ethylbenzothiazole-2-one-benzenesulfonyl hydrazone developer and 0.050 gm of 2-hydroxyethyl-1,4-naphthoquinone photoreductant and dried for 5 minutes at 45° C.

EXAMPLE 2

Laser Exposure of the Photosensitive Element

A multilayer, multicolor element prepared as described in Example 1 was optically addressed using an argon laser (power ranging between 5–40 mW). A stationary laser beam was focused with an 8 mm microscope objective (NA=0.4) and the film was edge mounted magnetically on a translation stage. Motion was provided at speeds ranging from 0.1 inch/sec to 2 inch/sec with the Anorad Computer Numeric Control (CNC) positioning system. Optical writing was carried out by changing focusing depth of the laser beam. The element was subsequently heat processed for two seconds at 130° C. High density cyan, magenta and yellow dye images corresponding to the focus series were obtained.

The invention has been described in detail with particular reference to preferred embodiments thereof, but it will be understood that variations and modifications can be effected within the spirit and scope of the invention.

We claim:

1. A method of generating visible multicolor images comprising the steps of (A) providing an image printing device comprising a single wavelength laser beam modulated with image information for generating at least two different colors;

(B) providing a multilayer color photographic imaging element which contains at least two different color imaging layers; wherein each layer (i) forms a developable latent image;

(ii) has a short exposure latitude;

(iii) has a well defined sensitivity threshold; and (iv) has a pronounced low intensity reciprocity failure; and (v) sensitive to the laser radiation.

(C) exposing each image layer to the laser by focusing the laser beam in and raster scanning each imaging layer separately to form a latent color image in each layer; and (D) developing a visible color image.

2. The method of claim 1 wherein the imaging element comprises separate magenta, cyan and yellow imaging layers in any order and the laser beam is modulated with magenta, cyan and yellow image information.

3. The method of claim 1 wherein each imaging layer is exposed sequentially by focusing the laser beam in and raster scanning each imaging layer one at a time.

4. The method of claim 1 wherein (a) the laser beam is optically split into two or more sub-beams;

(b) each sub-beam is individually modulated with different color image information; and (c) concurrently focusing each sub-beam on a different imaging layer thereby exposing all layers of the imaging element at the same time.

5. The method of claim 1 wherein each imaging layer of the element is separated by a barrier layer (a) which is transparent to the laser beam and (b) has a thickness of up to 30 microns.

6. The method of claims 1, 2, 3, 4 or 5 wherein the color imaging element is a multilayer silver halide color imaging element.

7. The method of claims 1, 2, 3, 4 or 5 wherein the color imaging element is a multilayer color photothermographic element.

8. The method of claim 7 wherein the multilayer color photothermographic element comprises a support bearing at least two different colored image forming layers which are sensitive to radiation of the same wavelength; wherein each layer comprises a binder having dissolved or dispersed therein (a) a color developer;

(b) a color coupler;

(c) a photoreductant; and (d) a cobalt(III) Lewis base complex.

9. The method of claim 7 wherein the multilayer color photothermographic element comprises a support bearing at least two different colored image forming layers which are sensitive to radiation of the same wavelength; wherein each layer comprises a binder having dissolved or dispersed therein (a) a leuco dye;

(b) a reducing agent;

(c) a photoreductant; and (d) a cobalt(III) Lewis base complex.

10. The method of claim 8 wherein the photothermographic element comprises separate yellow, magenta and cyan dye-forming layers.

11. The method of claim 8 wherein the photothermographic element comprises in each layer (a) a photoreductant;

(b) a sulfonamidophenol, aminophenol or a hydrozone color developer;

(c) a cobalt(III) hexammine complex; and (d) a different dye-forming coupler selected from (i)

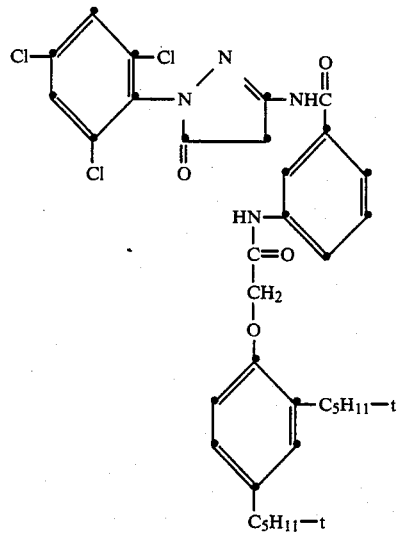

(ii)

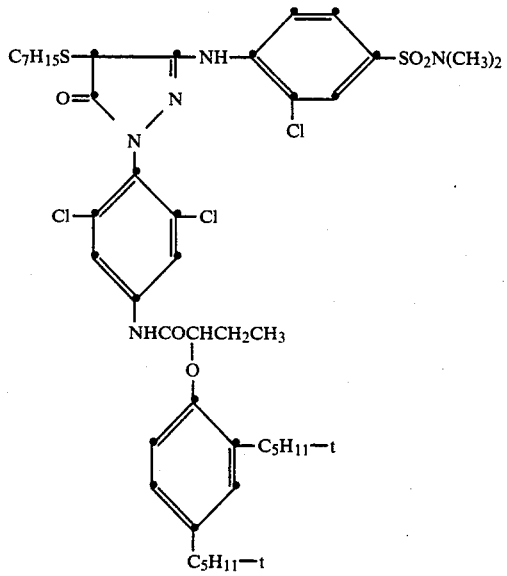

-continued
(iii)
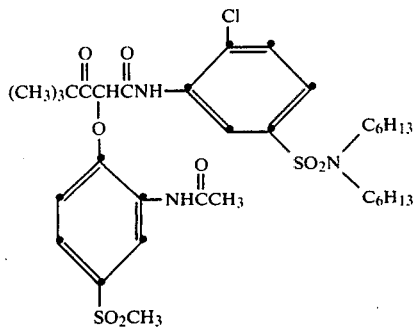
(iv)
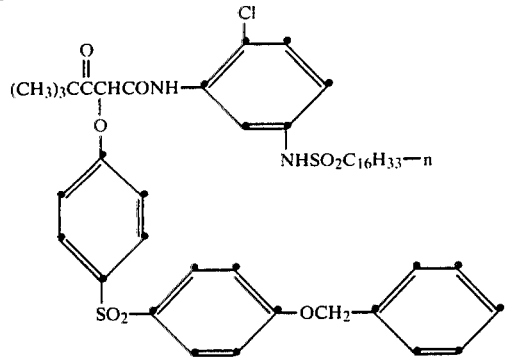
(v)
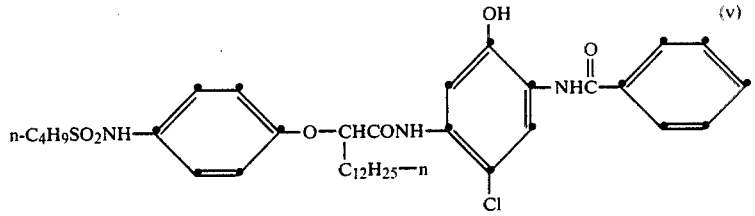
(vi)
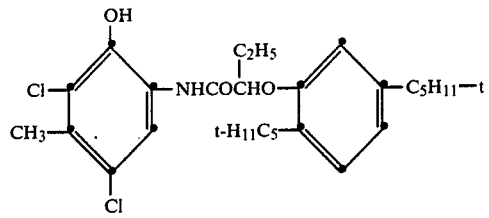
or combinations thereof.
12. The method of claim 7 wherein the multilayer color imaging element is a photothermographic element and development is carried out by heating the element.
13. The method of claim 8 or 9 which also includes barrier layers between two adjacent image-forming layers.
* * * * *